United States Patent [19]

Touret

[11] 4,314,516

[45] Feb. 9, 1982

[54] WORKPIECE GUIDE FOR SEWING MACHINES

[75] Inventor: Jean P. Touret, Chatillon, France

[73] Assignee: Rockwell-Rimoldi, S.p.A., Milan, Italy

[21] Appl. No.: 103,878

[22] Filed: Dec. 17, 1979

[30] Foreign Application Priority Data

Jan. 11, 1979 [IT] Italy ..... 19201 A/79

[51] Int. Cl.[3] ..... D05B 35/10

[52] U.S. Cl. ..... 112/152

[58] Field of Search ..... 112/152, 121.27, 153, 112/139

[56] References Cited

U.S. PATENT DOCUMENTS

| | | | |
|---|---|---|---|
| 790,560 | 5/1905 | De Nike | 112/152 |
| 2,674,213 | 4/1954 | Lopez | 112/121.27 |
| 2,840,020 | 6/1958 | Wise | 112/152 |
| 2,862,467 | 12/1958 | Passaro et al. | 112/152 |
| 3,515,081 | 6/1970 | Miller | 112/152 X |

*Primary Examiner*—Werner H. Schroeder
*Assistant Examiner*—A. Falik

[57] ABSTRACT

A guide for sewing machines for effecting the attachment of a waistband to a workpiece which includes a pair of U-shaped guide elements fixed on the machine in spaced and vertical alignment for guiding separated strips of band material to a converging position in close proximity with the machines stitching instrumentalities. The guide includes a dividing member selectively movable from an operative position between the guide elements to a position displaced therefrom. The dividing member is provided with surfaces that cooperate with the guide elements to form separate passageways for the strips of band material and a central member having a guide surface for guiding the edge of the workpiece between the separated strips of band material to the converging position.

4 Claims, 5 Drawing Figures

WORKPIECE GUIDE FOR SEWING MACHINES

BACKGROUND OF THE INVENTION

The present invention pertains to an improved device for sewing machines of the type for attaching waistbands onto garments which includes a pair of vertically aligned U-shaped elements defining channels for guiding a pair of aligned bands towards the stitching instrumentalites and between which a garment, hereinafter referred to as workpiece, is inserted prior to the start of stitching.

Guides for attaching waistbands to workpieces are well known to those conversant in the art and generally include a support bracket that is rotatably mounted on the base of the machine and which supports a pair of operatively associated guide elements. The guide elements are disposed in relatively close proximity and can be selectively pivoted away from one another for the purpose of facilitating the insertion of band material in each which together will form the waistband or belt when sewn onto a workpiece. After insertion of the band material the guide elements are then closed or pivoted back into close proximity with one another and the support bracket on which they are mounted is then rotated so as to position said elements in operating position which locates the central portion of the bands immediately adjacent to the stitching instrumentalities of the sewing machine.

An inserting element in the form of a thin blade member which can be manipulated by the machine operator and which generally forms a part of one of the two guide elements serves to engage and urge those portions of the bands protruding from said elements in the direction of the stitching instrumentalities so as to facilitate the start of the intended seaming operation.

These guide elements are usually provided with a means to effect a folding of the edges of the bands inwardly so that as the band is attached to the workpiece it will automatically be of a pre-determined width.

As is well known, the final preparatory operation prior to actual seaming is that of inserting that edge of the workpiece onto which a waistband is to be sewn between the two bands.

Each sewing operation necessitates what is considered an excessive amount of time on the part of an operator prior to the actual seaming operation to adequately set-up for the application of a waistband to a workpiece. First the operator must rotate the support bracket so as to move the entire guide to a position which will be clear of the stitching instrumentalities. The operator must then open or pivot the guide elements away from one another to positions of alignment whereat the band material is inserted into each of said elements. When a single band is utilized, special attention is required, for it is inserted in a folded condition and must, relative to its overall length be accurately located in order that it be properly attached to the workpiece during the seaming operation. The guide elements must then be closed or in other words pivoted back into operative association with one another. Next the support bracket has to be rotated which places the guide elements with their respective band immediately adjacent to the stitching instrumentalities, and finally the inserting element is manipulated so as to initiate the start of the seam.

An object of the invention is to provide an improved guide for attaching waistbands to workpieces that is of simplified construction, which will perform its intended function in a positive manner, and unlike known guides of the prior art will require substantially less preparatory operations on the part of an operator to initiate the start of sewing.

SUMMARY OF THE INVENTION

To accomplish the object of the invention a guide consisting of a pair of spaced and vertically aligned U-shaped guide elements with the legs of one element extending toward those of the other is fixed in its operating position forwardly of and in close proximity with the stitching instrumentalities of the machine. The U-shaped elements define channels for guiding band material to the sewing zone and access to the same is made possible by means of a single dividing member that is mounted for selective movement on the machine between a first position where it is interposed between said U-shaped elements and a second position displaced therefrom.

The dividing member is provided with upper and lower guiding surfaces and when said member is interposed between the spaced guide elements said guiding surfaces are disposed in close proximity with the legs of said guide elements and form substantially enclosed passageways through which the band material is advanced to the sewing zone. When the dividing member is swung to its inoperative position, that is displaced from the spaced guide elements, access is provided to the latter which enables the band material to be quickly inserted therein. The return of said dividing member to its operating position provides the necessary means for maintaining the band material in their respective passageways.

A particular advantage of the present invention is that of substantially decreasing the amount of time for effecting the preliminary operations by an operator prior to the start of sewing. The feature of having spaced guide elements with a displaceable dividing member greatly facilitates the insertion of band material and its arrangement adjacent the stitching instrumentalities where it is held through utilization of the machine's presser foot. By simply returning the dividing member to its operative position and then placing a workpiece between the strips of band material, the operator may commence sewing and said band material is maintained in proper separation while being advanced to the sewing zone.

Another advantage of the invention is that of being able to utilize band material that is formed either by a single pre-shaped strip that has been folded to form two bands or by two separate strips or bands. If the waistband is to be formed from a single strip, the workpiece onto which it is to be sewn is inserted between the folded band so that one edge thereof engages the fold which is held in position by the presser foot. If the waistband is formed by two separate strips, the ends adapted to be placed beneath the presser foot are folded so that they each engage their respective side of the workpiece to which they will be sewn. Additionally the trailing ends of the bands which complete the waistband can also be sewn to the workpiece in a folded condition by simply displacing the dividing member from its operating position just prior to completion of the seaming cycle which makes said ends readily accessible for folding manually.

Other objects and advantages of the invention will become more fully apparent by reference to the appended claims and as the following detailed description proceeds in reference to the figures of drawing wherein:

DESCRIPTION OF THE PREFERRED EMBODIMENT

Figure 1:
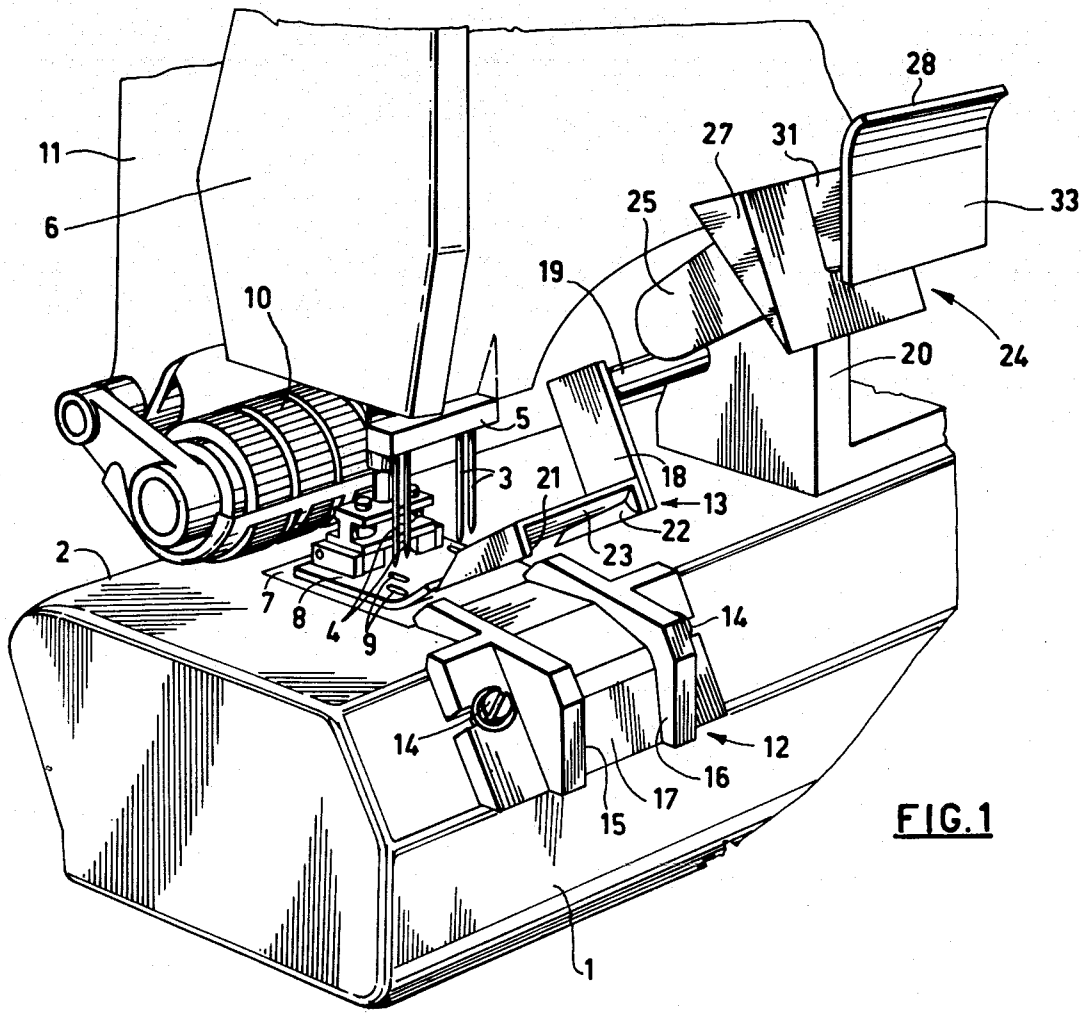
FIG. 1 is a perspective view of a portion of a sewing machine showing the device according to the invention applied thereto.

Now referring to the figures of drawings, enough of a sewing machine is shown in FIG. 1 to serve as a basis for a detailed description of the invention applied thereto. In FIG. 1 that portion of the sewing machine in the sewing zone area is shown and it includes among its various parts a base 1 having an upper horizontal planar surface 2 on which a workpiece is caused to be advanced by a conventional transport means such as a feed dog 39 shown in FIGS. 3 and 4. The needles of the machine are depicted by numerals 3 and 4 and are carried by a support clamp 5 that is attached to the lower end of a needle bar not shown, but which is mounted in a known manner for reciprocating movement within the head of the sewing machine that is identified by numeral 6.

The needles 3 and 4 as shown in FIG. 1 are arranged in spaced pairs and cooperate in a known manner with looper elements (not shown) that are housed within the base 1 beneath the machine's needle plate 7. This needle plate 7 is mounted on the planar surface 2 directly beneath the presser foot 8 which includes an equal number of needle holes 9 as there are needles 3 and 4. As is well known, the presser foot 8, during its intended function, cooperates with the feed dog 39 to effect advance of the workpiece during the sewing cycle. A conventional auxiliary transport device consisting of a knurled roller 10 is pivotably mounted on a support bracket 11 that is assembled to the rearward side of the head 6 so as to be in alignment with the direction of sewing and downstream of the presser foot 8.

The device for effecting attachment of waistbands to a workpiece according to the invention includes a pair of U-shaped guide elements 12 and 13 which are disposed one above the other in vertical alignment and in a manner whereby the leg portions or sidewalls of one element extend toward those of the other. The area intermediate the legs of each guide element 12 and 13 define channels which are inclined relative to one another so as to converge at a common location disposed forwardly of and in close proximity with the stitching instrumentalities of the machine which include the needles 3 and 4.

The lower of the two guide elements is depicted by numeral 12 and is fixed on the forward portion of the base 1 by means of screws 14. Being U-shaped as heretofore described, the sides of the guide element 12 define upwardly extending legs 15 and 16 with a lower interconnecting guide surface 17 that is oriented in the direction of sewing.

The upper guide element 13 being located above the guide element 12 is assembled on the lower end of a depending support plate 18. The upper end of this support plate 18 is fixed on one end of a shaft 19 with the opposite end of the latter being assembled in a support bracket 20 mounted on the base 1 of the machine. The end of shaft 19 assembles in the support bracket 20 in a manner whereby a means is provided to adjust the operating position of the upper guide element 13 relative to that of the lower guide element 12. The sides of the upper guide element 13 define downwardly extending legs 21 and 22 and with an upper interconnecting guide surface 23 which is also oriented in the direction of sewing and is disposed in generally opposed relation to the guide surface 17 of the lower guide element 12.

Figure 2:
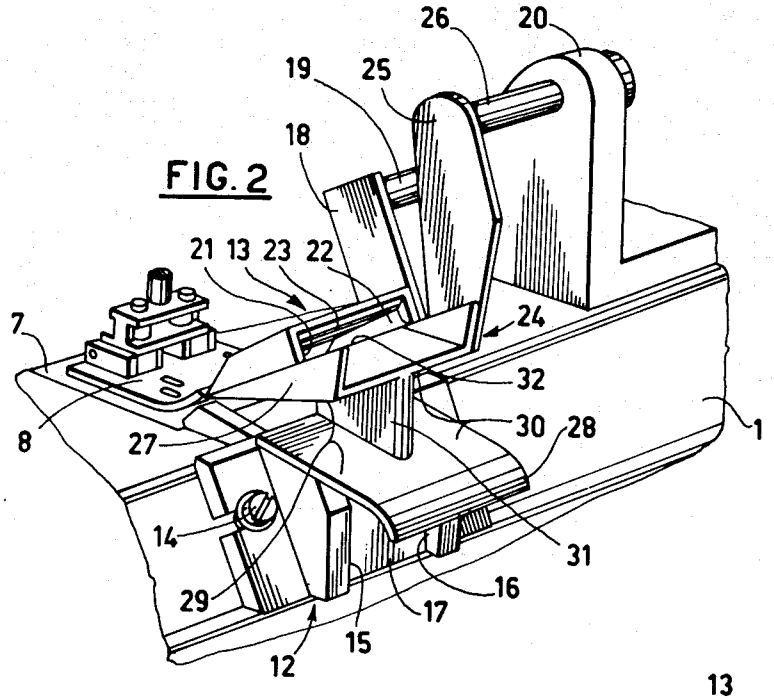
FIG. 2 is a perspective view of a portion of FIG. 1 showing the dividing member in its operating position.
Figure 3:
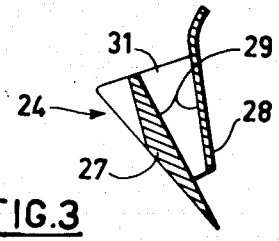
FIGS. 3 and 4 are views in side elevation and partially in section of the position of the dividing member as shown in FIGS. 1 and 2 respectively.
Figure 4:
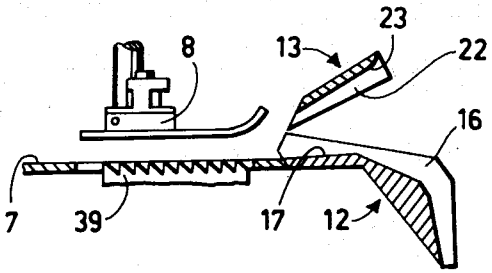
Figure 4:
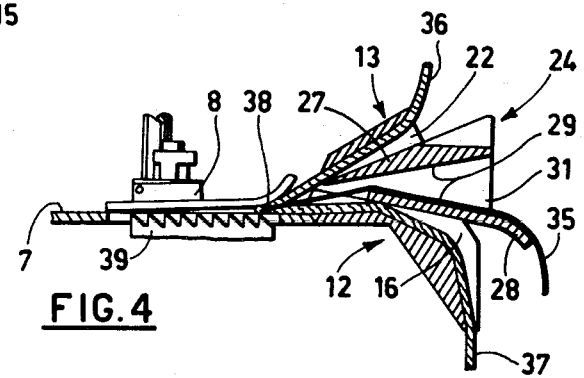

A dividing member generally indicated by numeral 24 is shown in FIGS. 1 and 2 as being attached to one end of an elongated support plate 25 whose opposite end is fixed to one end of a shaft 26 which extends parallel with shaft 19 and which is supported for pivotable movement in the support bracket 20. Being pivotably supported in this manner provides a means whereby the dividing member 24 can be inserted between the upper and lower guide element 12 and 13 as shown in FIGS. 2 and 4 or can be selectively pivoted therefrom to a position as shown in FIGS. 1 and 3. To facilitate insertion of the dividing member 24 to its operating position between the guide elements 12 and 13 which are inclined relative to one another, a dividing member has a configuration which is substantially that of a wedge and with the vertex thereof being directed toward the machines stitching instrumentalities.

The dividing member 24 includes an upper guide member 27 and a lower guide member 28 which are spaced one from the other so as to define two central openings 29 and 30 therebetween which are aligned with an extend in the direction of sewing. These openings are further defined by a central web 31 which interconnects the upper and lower guide members 27 and 28 and basically serve to fix the positions of these guide members relative to one another. The opening 30 is not essential for the purpose of the present invention. A workpiece to which a waistband is to be sewn is caused to advance only through opening 29 in a manner that will be more fully described hereinafter.

When the dividing member 24 is located in its operating position intermediate the guide elements 12 and 13, the central web 31 is in alignment with the central portions of the guide surfaces 17 and 23 of the guide element 12 and 13 respectively. The exterior surfaces of the upper and lower guide members 27 and 28 which form the dividing member 24, define lid elements 32 and 33 respectively. When the dividing member 24 is in its operating position, these lid elements 32 and 33 are disposed in close proximity with the terminus portions of the legs 15, 16 and 21, 22 respectively of the guide elements 12 and 13 and the combination of each define passageways having a cross-sectional configuration that is substantially rectangular.

Upon completion of each sewing cycle an operator in order to facilitate insertion of the band material that will be sewn to a workpiece during the next sewing cycle, raises the presser foot 8 from the needle plate 7 and pivots the dividing member 24 from that position shown in FIG. 4 to that position of FIG. 3.

Figure 5:
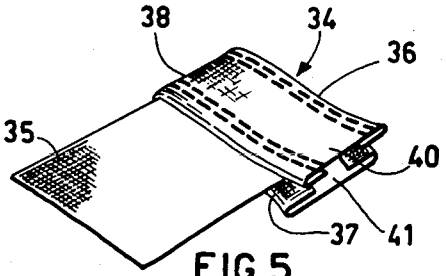
FIG. 5 is a perspective view of one form of waistband as attached to a workpiece by the device comprising the invention.

Referring now to FIG. 5, a waistband identified generally by numeral 34 is commonly formed from a strip of fabric that has been pre-formed to have its opposite sides folded inwardly. Additionally, the band 34 is folded at a location midway of its longitudinal length as shown at 38 so as to form two bands 36 and 37. The fold 38 of the band is placed on the leading edge of the needle plate 7 and then the presser foot 8 is lowered so as to engage said fold and is effective in maintaining said band in position for the start of the next seaming cycle. The operator then separates the two bands 36 and 37 which extend from the presser foot 8, so that the dividing member 24 will have sufficient clearance for pivoting the same to its operating position between the guide elements 12 and 13. Insertion of the dividing member into its operating position locates the separated bands 36 and 37 within their respective passageways which are formed by the combination of the lid elements 32, 33 and the legs 15, 16 and 21, 22 of the guide elements 12 and 13.

The final procedure prior to the start of sewing is that of inserting the workpiece into opening 29 so that the edge thereof engages the central web 31 which also serves as a guide surface, and then manually advancing the workpiece in the direction of sewing until its leading edge engages the fold 38 of the waistband 34 being held by the presser foot 8. The feed dog 39 and stitching instrumentalities are actuated simultaneously on starting the machine and with the band 34 and workpiece 35 being pre-positioned as described above, said feed dog is effective in immediately advancing said band and workpiece to said instrumentalities to initiate the start of seaming.

It should be readily understood from the foregoing and as shown in FIG. 5 that the workpiece becomes interposed between the two bands 36 and 37 as the sewing operation progresses. With the bands 36 and 37 and the workpiece 35 being advanced through separate passageways individual to each as described above, the invention provides simplified and positive means of attaching a waistband to a workpiece by smoothly advancing these elements and without interference with one another to the stitching instrumentalities of the sewing machine.

The simplified manual preparatory operation of arranging the workpiece and band material prior to the start of sewing is effective in attaching a waistband to said workpiece in the most desired manner whereby the leading edge of the latter is located within and in contact with the fold 38 of the waistband. Additionally this condition can be easily duplicated with the trailing end of the two bands 36 and 37 for just prior to completion of the sewing cycle, the operator simply pivots the dividing member 24 away from the guide elements 12 and 13 thus making the area between the latter readily accessible. With the dividing member 24 displaced in this manner, the operator can easily manipulate the end portions 40 and 41 of the bands 36 and 37 and fold them as desired just prior to the completion of sewing at which time said ends will be attached to the workpiece.

With the guide device according to the invention it is also possible for the central openings 29 and 30 in the dividing member 24 to accommodate other elements, such as loops, that form a part of a workpiece during the sewing cycle for said openings are free of obstructions which could cause an interference with such elements.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A device for simultaneously guiding separated strips of waistband material and a workpiece interposed therebetween to the stitching instrumentalities of a sewing machine of the type having a presser foot, a feed dog and an auxiliary transport device, said device comprising:

(a) a pair of U-shaped guide elements (12-13) mounted in spaced relation and in vertical alignment on the sewing machine including:
  (i) sides defining legs (15-16, 21-22) respectively, with the legs of one of said guide elements extending toward those of the other;
(b) a dividing member (24) pivotably mounted on the sewing machine and selectively movable from an operative position between said guide elements (12-13) to a position displaced therefrom, said dividing member including:
  (i) upper and lower guide elements (27-28) having exterior surfaces defining lid elements (32-33) for cooperating with said guide elements (12-13) respectively to form passageways for the separated strips of waistband material being advanced to the stitching instrumentalities; and
(c) means interconnecting said upper and lower guide elements (27-28) for guiding the workpiece being advanced with the strips of waistband material.

2. The device according to claim 1 wherein said guide elements (12-13) are inclined in the direction of the stitching instrumentalities so that the passageways formed thereby converge at a location common to both and in close proximity with the presser foot and feed dog to effect attachment of the waistband material to each side of the workpiece.

3. The device according to claim 2 wherein the dividing member (24) has a configuration substantially wedge shaped with the vertex thereof directed toward the presser foot to effect positioning of said lid elements (32-33) in close proximity with said guide elements (12-13) respectively when said dividing member is in its operative position.

4. The device according to claim 1 wherein said means interconnecting said upper and lower guide elements (27-28) defines a central web (31) with one side thereof forming a guide surface for engaging the edge of the workpiece that is advanced to the stitching instrumentalities between the strips of band material.

* * * * *